US006378972B1

(12) United States Patent
Akiyama et al.

(10) Patent No.: US 6,378,972 B1
(45) Date of Patent: Apr. 30, 2002

(54) DRIVE METHOD FOR AN ON-DEMAND MULTI-NOZZLE INK JET HEAD

(75) Inventors: Yoshitaka Akiyama; Takuji Torii; Nobuhiro Noto; Kazuaki Akimoto; Kazuo Shimizu; Shigenori Suematsu; Kenichi Kugai, all of Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/384,280

(22) Filed: Aug. 27, 1999

(30) Foreign Application Priority Data

Aug. 28, 1998 (JP) ..... P10-242761
May 18, 1999 (JP) ..... P11-136602

(51) Int. Cl.[7] ..... B41J 29/38; B41J 2/045
(52) U.S. Cl. ..... 347/10; 347/11; 347/68
(58) Field of Search ..... 347/9–11, 15, 347/54, 68, 71

(56) References Cited

U.S. PATENT DOCUMENTS 5,805,177 A * 9/1998 Takahashi ..... 347/11
6,086,189 A * 7/2000 Hosono et al. ..... 347/10
6,217,159 B1 * 4/2001 Morikoshi et al. ..... 347/10

* cited by examiner

*Primary Examiner*—John Barlow
*Assistant Examiner*—An H. Do
(74) *Attorney, Agent, or Firm*—Whitham, Curtis & Christofferson, P.C.

(57) ABSTRACT

To increase the size of dot printed on a print medium with an on-demand multi-nozzle ink jet head, at least two unit pulses are applied in succession to a piezoelectric element which varies the volume of an ink chamber. The unit pulse has a pulse width substantially equal to a period of Helmholtz natural oscillation determined based on dimensions, materials, and physical properties of an ink channel and the piezoelectric element and other components relating to oscillation. An off duration between adjacent unit pulses applied in succession to the piezoelectric element is preferably set one fifth to one fourth of the unit pulse width.

10 Claims, 6 Drawing Sheets

DRIVE METHOD FOR AN ON-DEMAND MULTI-NOZZLE INK JET HEAD

BACKGROUND OF THE INVENTION

1. Field of the Invention

The present invention relates to a drive method for an office-use or industrial-use ink jet printer with piezoelectric elements for ejecting ink on demand.

2. Description of the Related Art

There are thermal and piezoelectric type on-demand ink jet heads. Thermal type ink jet heads use heaters to boil a portion of ink filling the head, to generate a bubble. Ink is ejected by force of the expanding bubble. Piezoelectric type ink jet heads include a piezoelectric element that deforms a portion of an ink chamber wall, in order to apply pressure to ink in the chamber and eject an ink droplet.

Thermal heads are advantageous because they can be formed using lithography to a fine nozzle pitch of 100 $\mu$m or less. However. thermal heads can only be driven at an ejection frequency of about 10 to 12 kHz during consecutive ejection. Also, only liquids with a boiling point of about 100° C. can be used as the liquid to be ejected, which hinders broad use of thermal heads in industry.

With regard to piezoelectric type heads. piezoelectric elements deform only in small amounts. so the diaphragm in the ink chamber must have a large surface area to produce sufficient deformation for ink ejection. As a result, the nozzle pitch of piezoelectric type heads can not be formed smaller than about 140 $\mu$m. However, piezoelectric type heads are well suited for high speed printing. That is, the drive frequency depends on the shape of the piezoelectric elements, so piezoelectric elements can be driven at a frequency of 20 kHz or more. Also, piezoelectric type heads are well adapted for industrial use, because in contrast to thermal type heads, they can be used to eject any type of liquid.

Conventionally, there are a variety of proposals for varying dot size ejected by ink jet heads. U.S. Pat. No. 5,495,270 discloses an ink jet apparatus capable of gray-scale printing. When the meniscus of ink in a nozzle is oscillated and a droplet ejected, the diameter of the ejected droplet will depend on the size of the center excursion (peak) in the meniscus. U.S. Pat. No. 5,495,270 discloses oscillating the meniscus to produce three different cross-sectional contours in the meniscus; (1) a contour with a single excursion, (2) a W-shaped contour. that is, with a single independent excursion and two peripheral excursions, and (3) a contour with three independent excursions. The contour (1) has the largest central excursion, contour (2) the second largest, and contour (3) the smallest. Accordingly, diameters of ejected droplets are largest to smallest in the order of contour (1) to (3). To generate meniscus oscillation of a specified contour, natural oscillation corresponding to the specified contour is used but natural oscillations corresponding to the remaining contours are not used. However, when the drive waveform is determined to contain the relevant natural oscillation, the pulse width becomes relatively long, thereby making high frequency driving difficult.

Japanese Laid-Open Patent Publication (Kokai) No. HEI-8-336970 discloses an ink jet head capable of multi-tonal printing. In order to change the volume of droplets that impinge on a recording medium, the waveform used to drive the piezoelectric element is changed to eject two ink droplets in succession, so that the two droplets merge during flight time. However, this technique is disadvantageous in that the resultant large-volume ink droplet can splash when it impinges on the recording medium, thereby staining the recording medium. Also, because a great deal of ink impinges on the recording medium at once, the ink can run so that images blur.

SUMMARY OF THE INVENTION

It is an object of the present invention to provide a method of effectively varying dot size ejected by piezoelectric type heads, which have a broad range of applications in industry.

It is another object of the present invention to provide a drive method for driving an ink jet head that enables freely changing the volume of ejected ink droplets using a drive waveform that has a pulse width of reasonable length, in order to perform high quality tonal printing without staining the recording medium.

To achieve the above and other objects, the present invention provides a drive method for an on-demand multi-nozzle ink jet head. The head includes an ink chamber filling ink therein and defined by a diaphragm and an orifice plate formed with orifices therein, a piezoelectric element which is attached to the diaphragm and deforms when a drive pulse is applied to the piezoelectric element, thereby varying pressure in the ink chamber, an ink channel for supplying ink to the ink chamber, and a common ink channel in fluid communication with the ink channel. The drive method includes the steps of:

determining a unit pulse having a pulse width, the pulse width being determining while referring to a period of Helmholtz natural oscillation;

determining an off duration paused between two successive unit pulses, the unit pulse and subsequent off duration forming a drive pulse for applying to the piezoelectric element, the off duration being equal to or less than one fourth of the pulse width of the unit pulse; and applying a predetermined number of drive pulses in succession to the piezoelectric element when an instruction is given to increase a size of dot on a print medium.

The period of Helmholtz natural oscillation is determined based on dimensions, materials, and physical properties of the ink channel and the piezoelectric element. Preferably, the pulse width of the unit pulse is determined to be equal to the period of Helmholtz natural oscillation.

The off duration is preferably between one forth to one fifth of the pulse width of the unit pulse.

The print medium is position a predetermined distance apart from the orifice plate so that first two ink droplets ejected in response to first two drive pulses merge during flight time, and,at least one ink droplet ejected following the first two ink droplets in response to a subsequent drive pulse merges the first two ink droplets on the print medium.

The number of drive pulses for printing one combined dot may be two, three, and four. A frequency of the drive pulses can be 25 kHz at maximum.

According to the present invention, a dot of one to four times a volume of nominal dot can be printed by applying a multiple of drive pulses to the piezoelectric element in succession. This enables printing dots in desired sizes. Also, by using three unit pulses or less, printing can be performed at high frequencies of up to 25 kHz. Further, because printing is performed by merely repeating a simple pulse shape, electrical circuitry related to ink ejection can be made with a simple configuration.

BRIEF DESCRIPTION OF THE DRAWINGS

The above and other objects, features and advantages of the present invention will become more apparent from the following description when taken in conjunction with the accompanying drawings, in which:

FIG. 7(*b*) is a graphical representation showing change in the pressure in an ink chamber as time elapses;

DETAILED DESCRIPTION OF THE PREFERRED EMBODIMENTS

Figure 1:
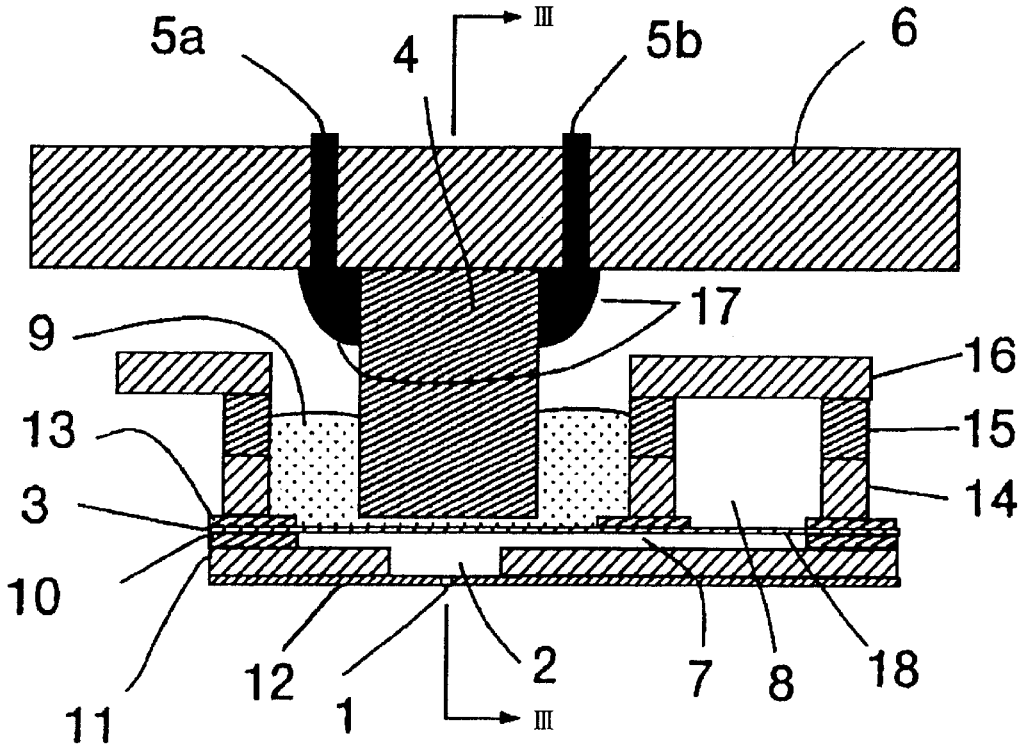
FIG. 1 is a cross-sectional enlarged view showing an arrangement of a nozzle in an ink jet heat used in the preferred embodiment of the present invention.
Figure 3:
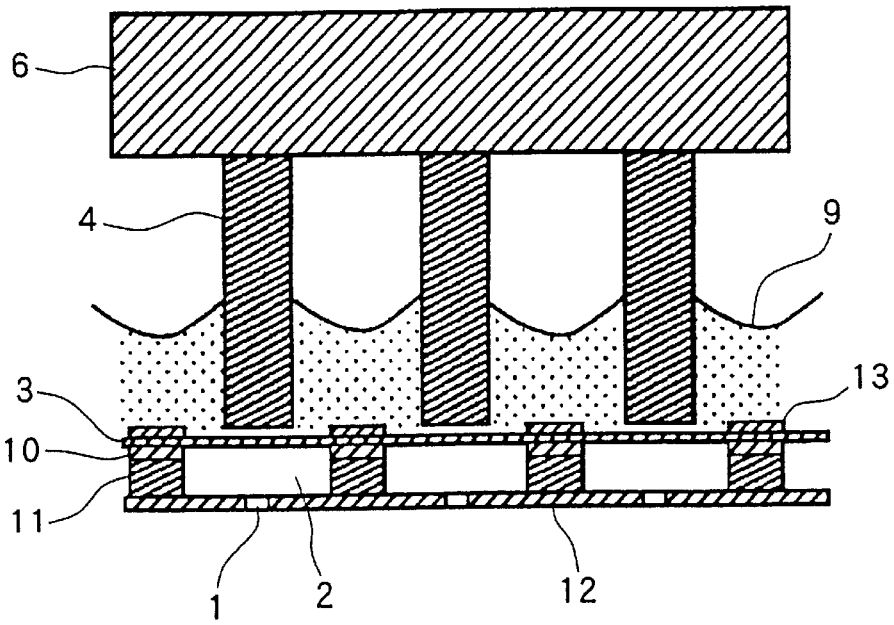
FIG. 3 is a cross-sectional view taken along line III—III of FIG. 1.

FIGS. 1 and 3 show a nozzle portion of a multi-nozzle ink jet head according to a preferred embodiment of the present invention. FIG. 3 is a cross-sectional view taken along line III—III of FIG. 1. The head ejects ink according to a print signal to record images. The print signal is applied to signal input terminals 5*a,* 5*b*.

As shown in FIG. 3, a plurality of piezoelectric elements 4 are aligned in a one-to-one correspondence with a corresponding plurality of ink chambers 2. As best seen in FIG. 1, one end of each piezoelectric element 4 is secured to a head substrate 6, which is made from an insulating material. such as ceramics or polyimide. The other end of each piezoelectric element 4 is attached to a diaphragm 3 by a resilient material 9, such as silicon adhesive. The piezoelectric elements 4 are connected to external control wires (not shown) by the signal input terminals 5*a,* 5*b* and conductive adhesive 17.

The ink chambers 2 are defined by a chamber plate 11 and an orifice plate 12, which is formed with orifices 1. A support plate 13 is provided for reinforcing the diaphragm 3. A restricter 7 for controlling flow of ink into the ink chambers 2 is defined by a restricter plate 10. The restricter 7 connects the ink chambers 2 with a common ink supply channel 8. which is defined by common ink supply channel plates 14, 15 and a common ink supply channel cover 16. A filter 18 is disposed between the restricter 7 and the channel 8. The diaphragm 3, the restricter plate 10, the chamber plate 11, and the support plate 13 are formed from stainless steel. The orifice plate 12 is formed from nickel.

Ink is supplied from a common ink supply channel 8 into the ink chambers 2 through individual restricters 7 defined by the restricter plate 10 and the diaphragm 3.

A print signal in the form of a drive voltage is applied through the input terminals 5*a,* 5*b* to each piezoelectric element 4, to selectively deform the piezoelectric elements 4. Each piezoelectric element 4 used in this embodiment contracts when applied with a drive voltage when application of the drive voltage is stopped, the piezoelectric element 4 reverts to its initial length. At this timing, an ink droplet is ejected from the orifice.

To eject an ink droplet, the drive voltage is applied to the piezoelectric element 4, so that the piezoelectric element 4 contracts in a direction away from the ink chamber 6. This deforms the diaphragm 3 to increase the volume of the ink chamber 2. thereby introducing ink into the ink chamber 2. When application of the drive voltage is stopped, the piezoelectric element 4 reverts to the elongated condition, so that the pressure in the ink chamber 2 increases and thus ink droplet is ejected.

Figure 2:
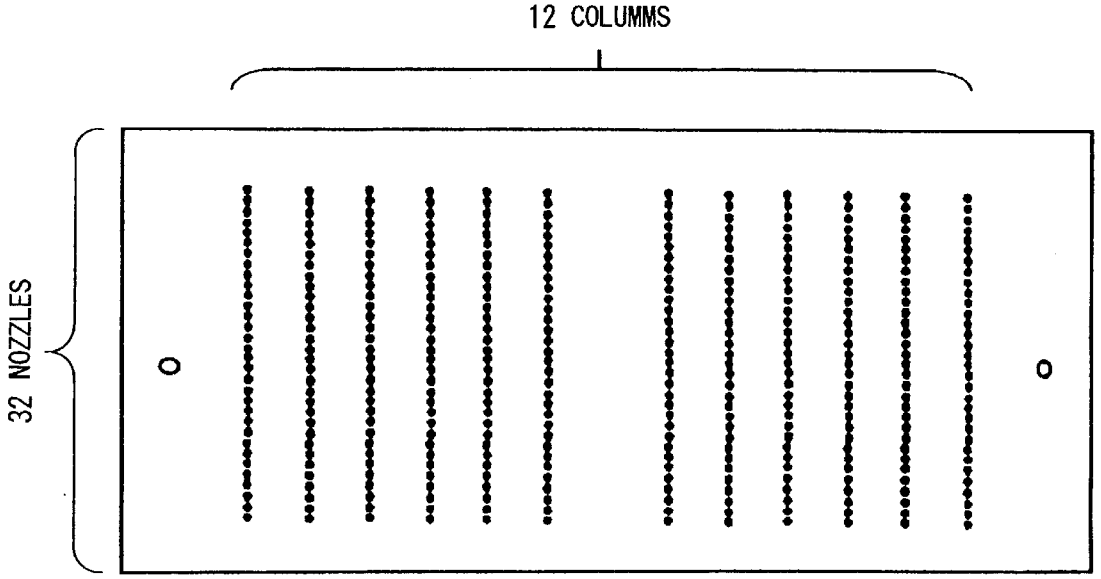
FIG. 2 is an explanatory diagram showing arrangement of orifices in the ink jet head used in the preferred embodiment of the present invention.

FIG. 2 shows nozzle rows of an ink jet head according to the present invention. As shown in FIG. 2, the ink jet head is formed with 12 nozzle rows, with 32 nozzles aligned in each row for a total of 384 nozzles.

Figure 4:
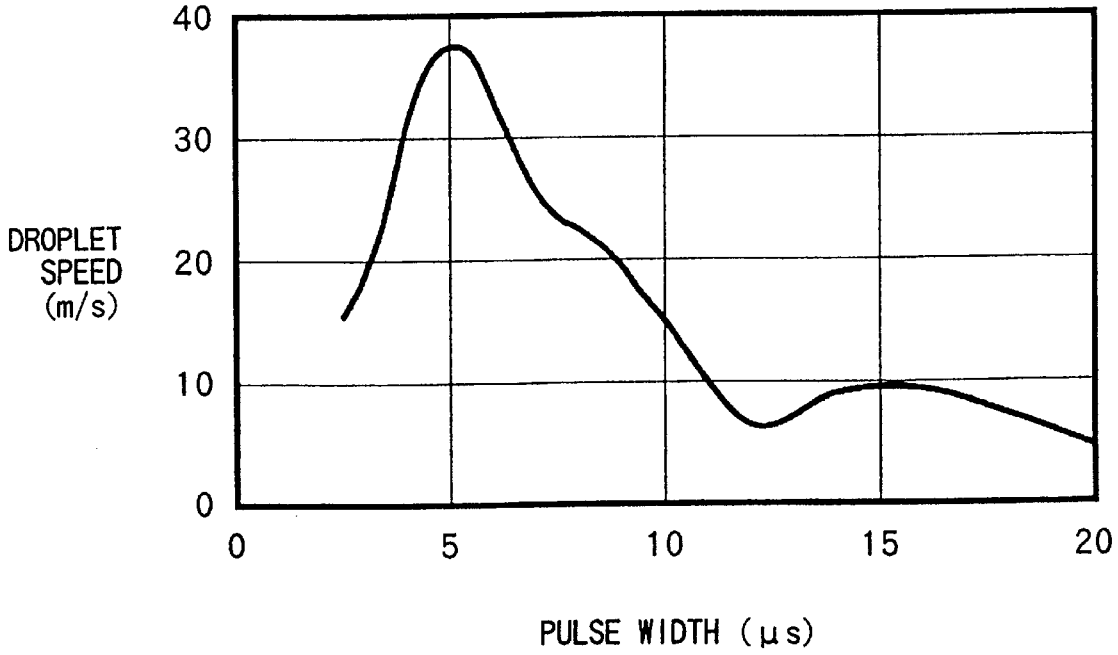
FIG. 4 is a graphical representation showing a relationship between a pulse width and the droplet speed with a fixed voltage level.

FIG. 4 shows a graph showing how changes in width of drive pulses having the same voltage affect speed of ejected ink droplets. In FIG. 4, peaks in ink droplet speed appear in the graph curve at pulse widths of 5 μseconds and 15 μseconds. These peaks represent resonance at the Helmholtz natural oscillation of the nozzles. The Helmholtz natural oscillation of the nozzles is determined by a variety of factors including the dimensions, materials, and physical properties of the ink channels, the piezoelectric elements, and other components relating to oscillation. The Helmholtz oscillation of nozzles in the example of FIG. 4 is about 100 kHz (=1/(15 μs−5 μs)).

Figure 5:
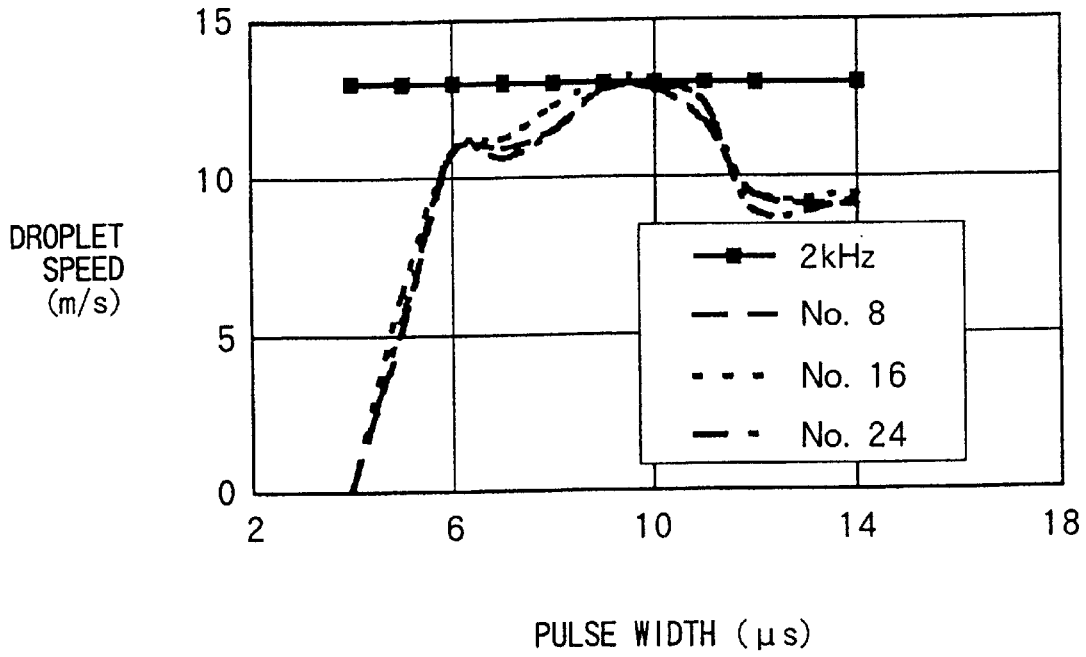
FIG. 5 is a graphical representation showing a relationship between a pulse width and the droplet speed with varying frequency.

On the other hand. one particular nozzle was selected from nozzles of the ink jet head having the above-described configuration, and drive pulses having rectangular waveforms of different widths were applied to the corresponding piezoelectric element. The voltage required to achieve a droplet lead speed of 13 m/s at a relatively low frequency of 2 kHz was determined for each pulse width. Next, drive pulses with these pulse widths and relevant voltages thus determined were then applied at an increased frequency of 20 kHz. and the resultant ink droplet speeds were measured. FIG. 5 shows the results of these measurements.

The line labeled 2 kHz indicates that a droplet speed of 13 m/s was achieved at 2 kHz by application of a variety of drive pulses varying in pulse width and by adjusting the voltage of the pulses. The voltage that achieved a droplet lead speed of 13 m/s was determined for each pulse width. Droplet speeds achieved at the determined voltages was investigated by applying the pulses at a frequency of 20 kHz to nozzle positions 8, 16, and 24 of the print head, as indicated by lines 8, 16, and 24 respectively in FIG. 5.

FIG. 5 shows that when the pulse width was 10 μsec, droplet speed varied little between those ejected at the frequency of 2 kHz and those at the frequency of 20 kHz. As mentioned previously, the Helmholtz oscillation frequency is about 100 kHz. This 10 μsec pulse width therefore matches the period of the Helmholtz oscillation. A pulse with the pulse width of 10 μsec will be referred to as a unit pulse. When the nozzles are driven using two or more unit pulses, the volume of ejected ink droplets can be incrementally decreased.

Figure 6:
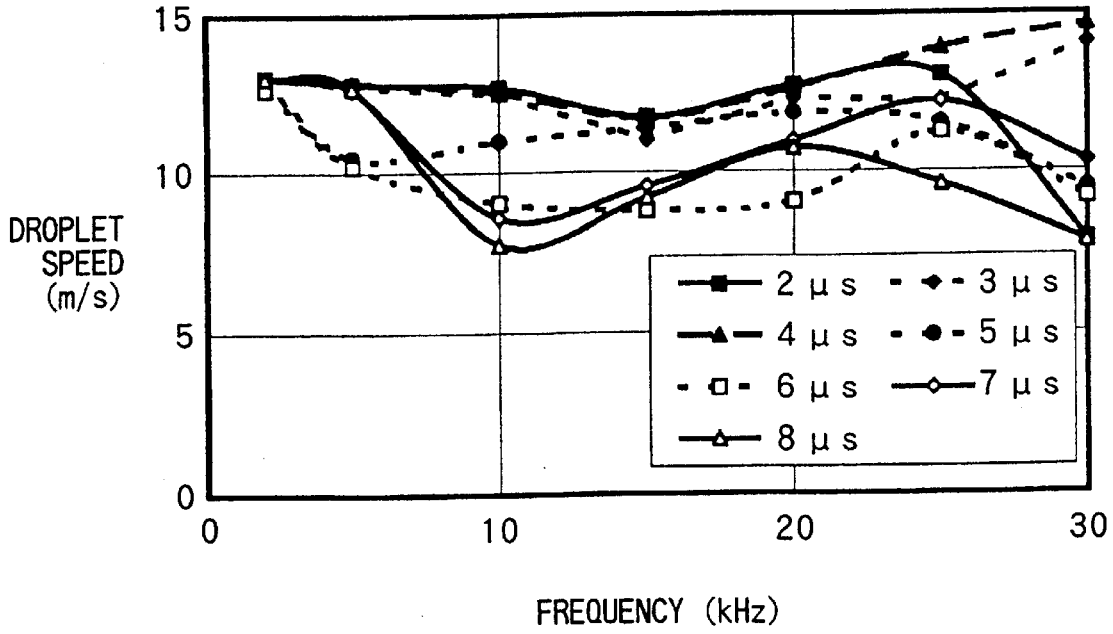
FIG. 6 is a graphical representation showing a relationship between a frequency and the droplet speed.

The optimum off duration between adjacent unit pulses is determined in the following manner FIG. 6 shows a graph representing the relationship between drive frequency on the his of abscissas and droplet lead speed on the axis of ordinates. The off duration between adjacent unit pulses was varied from 2 to 8 μsec. The graph indicates droplet speed resulting from application of the unit pulses varying in the off duration.

Droplet speed varied considerably when the off duration between adjacent unit pulses was set to 5 μsec or greater. However, droplet speed varied little when the off duration was set. to 2 to 4 μsec, even when the frequency was increased up to 25 kHz.

Figure 7:
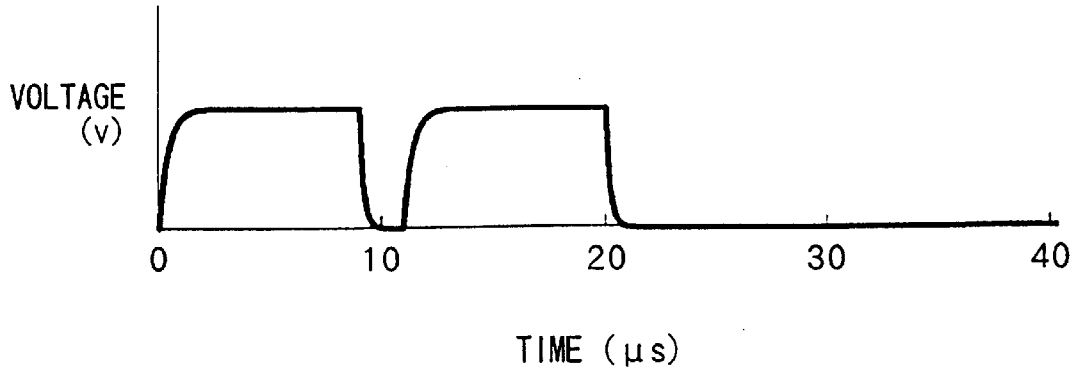
FIG. 7(*a*) is a graphical representation showing voltage applied to a piezoelectric element.
Figure 7:
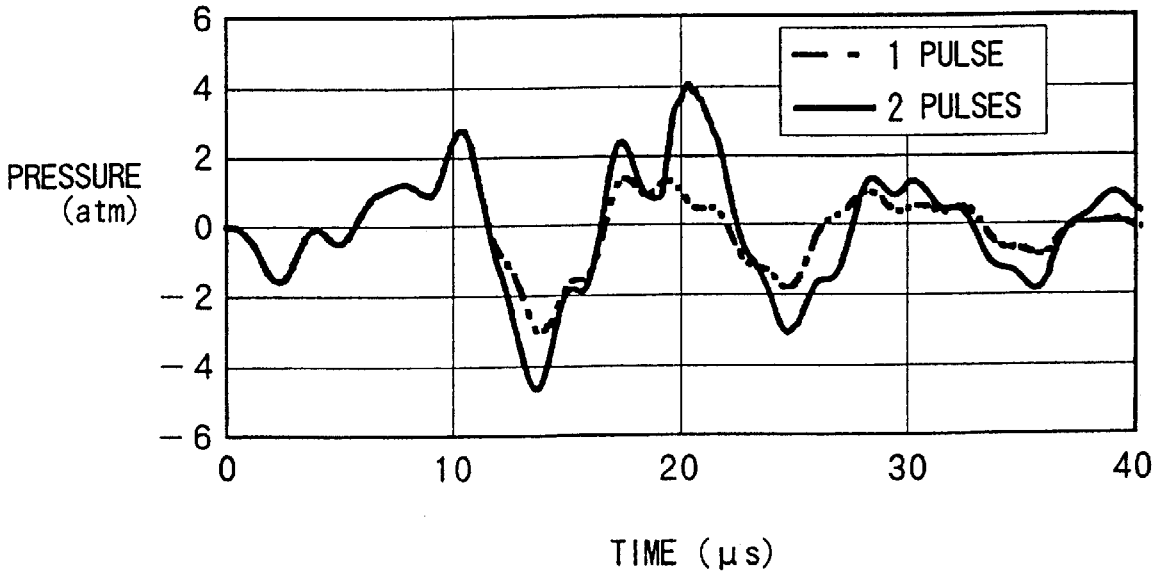

The following investigation was performed to determine why droplet speed remains relatively constant when the off duration is short. FIG. 7(*b*) is a graph showing results of numerical analysis relating to the above-described configuration. in the graph, the axis of abscissas represents time and the axis of ordinates represents pressure change in the ink chamber. The period of Helmholtz oscillation is 10 μsec.

As shown in FIG. 7(*a*), the timing at which no voltage difference is developed between the signal input terminals of the piezoelectric element is 9 μsec on the time axis. After the resultant first ink droplet is ejected at a timing of 11 μsec, pressure in the ink chamber decreases and reaches a maximum negative pressure at the timing of 13.5 μsec.

The period between timing of 11 μsec and timing 13.5 μsec, that is, when the pressure in the ink chamber decreases, corresponds to the above-described 2 to 4 μsec. off duration after application of a first drive pulse is stopped.

Based on this analysis, the following reason can be given for why droplet speed changes only slightly when a subsequent drive pulse is applied after an off duration of 2 to 4 μsec. When a first drive pulse is applied to a piezoelectric element, the piezoelectric element starts deforming with the rising edge of the first drive pulse, and an ink droplet is ejected when pressure in the ink chamber has reached a peak point. Afterward, the pressure in the ink chamber starts decroasing. If a second drive pulse is applied while pressure in the ink chamber is decreasing, then greater negative pressure can be attained as shown by solid line in FIG. 7(*b*). That is, by applying subsequent drive pulses while pressure in the ink chamber is decreasing, then a large pressure difference can be generated between the ink chamber and atmosphere. ink can therefore be smoothly refilled into the ink chamber and ejection of the next ink droplet can be efficiently performed.

Because the period of the Helmholtz oscillation is 10 μsec according to the present embodiment, it is desirable to apply a subsequent drive pulse during an off duration from (11–9)μsec/10 μsec=2/10 to even a maximum of (13.5–9) μsec/10 μsec=4.5/10 or less.

Figure 8:
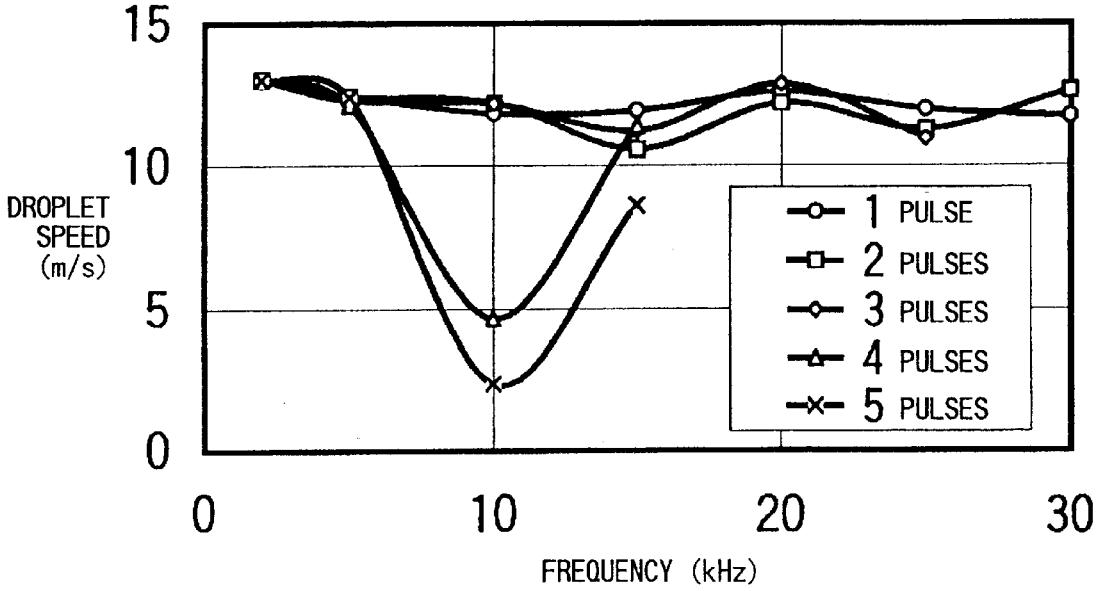
FIG. 8 is a graphical representation showing a relationship between the frequency and the droplet speed when the number of pulses are changed from 1 to 5.

FIG. 8 is a graph showing the relationship between droplet speed and drive frequency when a print head is driven by the above-described single pulse and two to five consecutive pulses, wherein the off duration between adjacent pulses is 2 μsec (about ⅕ the period of the Helmoltz oscillation).

It can be seen in FIG. 8 that droplet speed fluctuates only slightly even up to a frequency of 25 kHz when two or three consecutive pulses are applied. However, when four or five consecutive pulses are applied, droplet speed abruptly drops at frequencies in the vicinity of 10 kHz. When the ink droplet speed fluctuates during ink jet printing, the ejected droplets can impinge at undesired positions on the printing medium, thereby adversely affecting print quality. However, printing can be properly performed at frequencies of up to 25 kHz as long as consecutive driving with three or fewer pulses is performed. However, from the practical point of view, the number of drive pulses to be sequentially applied to the piezoelectric element can be four at maximum.

Figure 9:
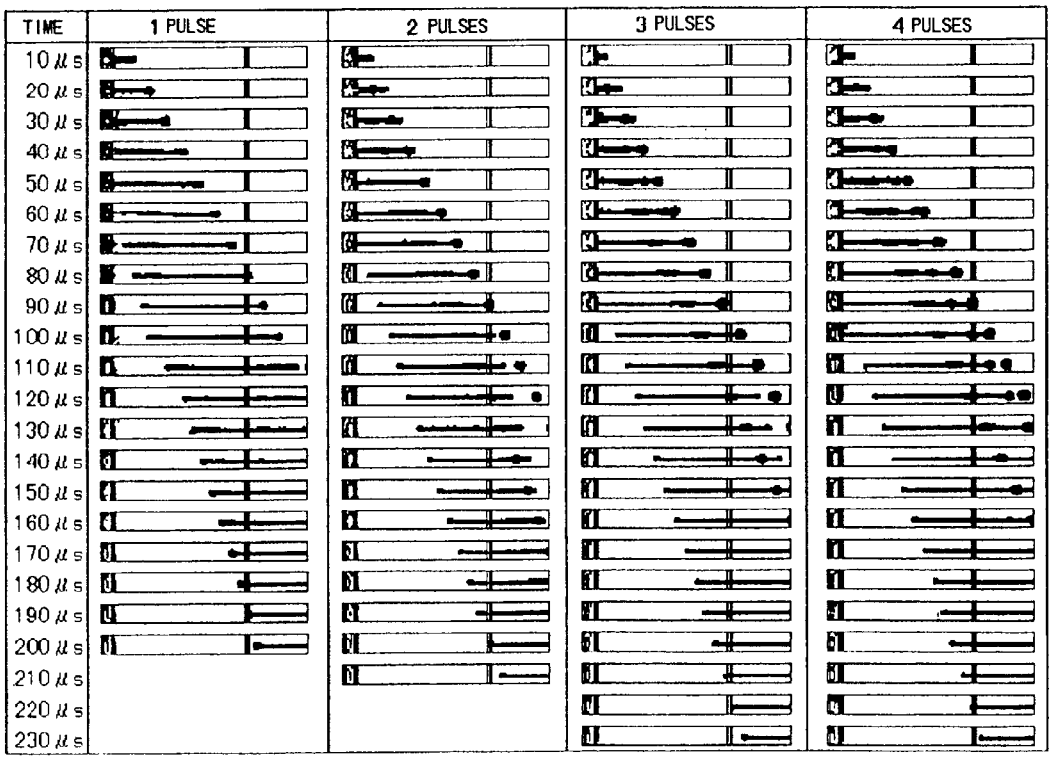
FIG. 9 is an explanatory diagram showing the flight of ink droplet.

FIG. 9 shows stroboscopic photographs taken of ink droplets to determine flight of the droplets. The same conditions were used as described above, that is, nozzles with a Helmholtz oscillation period of 10 μsec were used and drive voltages where applied to achieve a droplet lead speed of 13 m/sec. The times shown in FIG. 9 indicate the time elapsed from when the lead end of the droplet ejected by the-first pulse emerges from the orifice plate. Also, "1 pulse" indicates when the waveform of the drive pulse included a single unit pulse. Similarly, "2 pulses," "3 pulses," and "4 pulses" indicate when the drive pulse waveform includes a corresponding plurality of unit pulses separated by an off duration of 2 μsec. The vertical line near the right side of each photograph indicates the position of the recording medium.

According to the drive method of the present invention, multi-pulse waveforms are constructed from unit pulses having a pulse width determined while referring to the period of Helmholtz oscillation. Preferably, the pulse width is determined to be substantially equal to or exactly equal to the period of Helmholtz oscillation. An off duration between adjacent unit pulses is less than ¼ of the pulse width. Preferably, the off duration is equal to ⅕ to ¼ of the pulse width. When printing is performed using such waveforms. ink droplets ejected by the first and second unit pulses merge during flight time. However, the ink droplets ejected by third and fourth unit pulses impinge on the recording medium as separate ink droplets. That is, the ink droplets merge on the recording medium, not in flight. For this reason, ink droplets will not splash on the recording medium. which can happen when a large ink droplet impinges on a recording medium.

Figure 10:
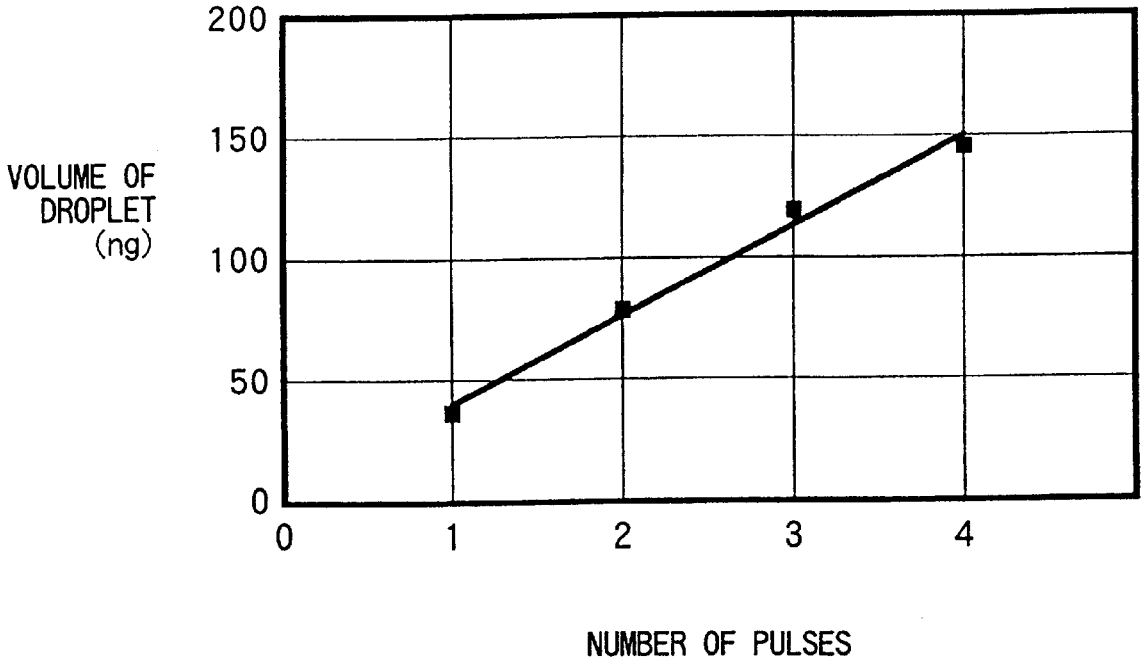
FIG. 10 is a graphical representation showing a relationship between the number of pulses and the ink amount.

FIG. 10 is a graph showing the relationship between volume of ejected ink droplets and pulse number. As can be seen therefrom, the volume of ejected ink droplets increases proportionally with the number of pulses.

While only one exemplary embodiment of this invention has been described in detail, those skilled in the art will recognize that there are many possible modifications and variations which may be made in this exemplary embodiment while yet retaining many of the novel features and advantages of the invention. Accordingly, all such modifications and variations are intended to be included within the scope of the appended claims.

What is claimed is:

1. A drive method for an on-demand multi-nozzle ink jet head including an ink chamber filling ink therein and defined by a diaphragm and an orifice plate formed with orifices therein, a piezoelectric element which is attached to the diaphragm and deforms when a drive pulse is applied to the piezoelectric element, thereby varying pressure in the ink chamber, an ink channel for supplying ink to the ink chamber, and a common ink channel in fluid communication with the ink channel, the method comprising the steps of:

determining a unit pulse having a pulse width, the pulse width being determined while referring to a period of Helmholtz natural oscillation and being substantially equal to the period of the Helmholtz natural oscillation;

determining an off duration paused between two successive unit pulses, the unit pulse and subsequent off duration forming a drive pulse for applying to the piezoelectric element, the off duration being equal to or less than one fourth of the pulse width of the unit pulse; and applying a predetermined number of drive pulses in succession to the piezoelectric element when an instruction is given to increase a size of dot on a print medium.

2. The method according to claim 1, further comprising the step of determining the period of Helmholtz natural oscillation based on dimensions, materials, and physical properties of the ink channel and the piezoelectric element.

3. The method according to claim 2, wherein the off duration is preferably between one forth to one fifth of the pulse width of the unit pulse.

4. The method according to claim 1, wherein the print medium is positioned a predetermined distance apart from the orifice plate so that first two ink droplets ejected in response to first two drive pulses merge during flight time, and at least one ink droplet ejected following the first two ink droplets in response to a subsequent drive pulse merges the first two ink droplets on the print medium.

5. The method according to claim 4, wherein the predetermined number of drive pulses is three.

6. The method according to claim 5, wherein a frequency of the drive pulses is 25 kHz at maximum.

7. The method according to claim 4, wherein the predetermined number of drive pulses is two.

8. The method according to claim 4, wherein the predetermined number of drive pulses is four.

9. A drive method for an on-demand multi-nozzle ink jet head including an ink chamber filling ink therein and defined by a diaphragm and an orifice plate formed with orifices therein, a piezoelectric element which is attached to the diaphragm and deforms when a drive pulse is applied to the piezoelectric element, thereby varying pressure in the ink chamber, and a common ink channel in fluid communication with the ink channel, the driving method comprising the steps of:

determining a voltage for each of a plurality of pulses each having different pulse width, the voltage being required to achieve a predetermined droplet flying speed at a lower frequency;

determining one of the plurality of pulses for which a droplet flying speed is changed by a relatively small amount when the frequency is increased to a higher frequency; and applying the drive pulse including the determined one of the plurality of pulses to the piezoelectric element.

10. The drive method according to claim 9, further comprising the steps of:

setting the determined one of the plurality of pulses as a unit pulse; and determining an off duration paused between successive unit pulses, the off duration changing the droplet flying speed by a relatively small amount, wherein the drive pulse is formed from the unit pulse and the determined off duration following the unit pulse.

* * * * *